US006182967B1

(12) United States Patent
Green

(10) Patent No.: US 6,182,967 B1
(45) **Date of Patent: *Feb. 6, 2001**

(54) BOARD GAME HAVING DYNAMIC GAME PIECES

(76) Inventor: Donald P. Green, 93 McKinley Ave., New Haven, CT (US) 06515

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/209,185

(22) Filed: Dec. 10, 1998

(51) Int. Cl.[7] ..... A63F 3/02

(52) U.S. Cl. ..... 273/290; 273/260; 273/280; 463/9

(58) Field of Search ..... 273/288, 289, 273/290, 291, 240, 236, 280, 281, 255; 463/9, 15

(56) References Cited

U.S. PATENT DOCUMENTS 3,751,039 * 8/1973 Dykoski .
4,073,067 * 2/1978 Beach .
4,200,293 * 4/1980 Benson .
4,226,419 * 10/1980 Wooden .
4,398,720 * 8/1983 Jones .
5,013,047 * 5/1991 Schwab .
5,098,106 * 3/1992 Hegener .
5,520,396 * 5/1996 Therrien .
5,754,179 * 5/1998 Hocker .

FOREIGN PATENT DOCUMENTS

2487686 * 2/1982 (FR) .

* cited by examiner

*Primary Examiner*—Jeanette Chapman
*Assistant Examiner*—V K Mendiratta
(74) *Attorney, Agent, or Firm*—McCormick, Paulding & Huber LLP

(57) ABSTRACT

A board game has two teams of a plurality of game pieces whereby, on successive turns, a player may add a game piece, move a game piece, or enhance the movement direction capabilities of a game piece. The object of the game is to occupy designated opponent's territories on the game board or to capture all of the opponent's game pieces so that none remain on the game board.

32 Claims, 5 Drawing Sheets

BOARD GAME HAVING DYNAMIC GAME PIECES

TECHNICAL FIELD

The present invention relates to board games and, more particularly, to a board game that has selectively dynamic game pieces which change functional characteristics during play.

BACKGROUND OF THE INVENTION

Various board games exist in which movable playing pieces representing opposing players are moved in accordance with prescribed directions, distances and sequences. In some games, such as Chinese checkers for example, all game pieces have the same movement characteristics in terms of distance and direction. Other games, such as chess or standard checkers, involve game pieces having specific movement characteristics and capturing capabilities that vary among different game pieces.

In the aforementioned games, however, the dynamic quality of each game piece is limited. As a result, the degree to which a player can strategically surprise his opponent is limited in the sense that in checkers, for example, once a game piece is enhanced it will not be changed again. When a checker game piece is crowned, its movement characteristics will remain the same for the rest of the game. In chess, aside from well executed strategy, the only element of surprise is the recovery of a captured game piece. Recovery of a captured game piece in chess is fairly predictable in terms of guessing which captured game piece an opponent will choose to recover, and when such recovery will occur if at all. In neither chess nor checkers, does a game piece have optional modes of movement beyond a few degrees of variation in direction.

OBJECT AND SUMMARY OF THE INVENTION

It is an object of the present invention to provide a board game having game pieces that are selectively dynamic with respect to movement direction and distance, and degrees thereof.

It is another object of the present invention to provide a board game in which game pieces are physically altered to indicate particular movement characteristics of the particular game piece.

These objects and other inherent advantages of the present invention are described herein.

DESCRIPTION OF THE PREFERRED EMBODIMENT

Figure 1:
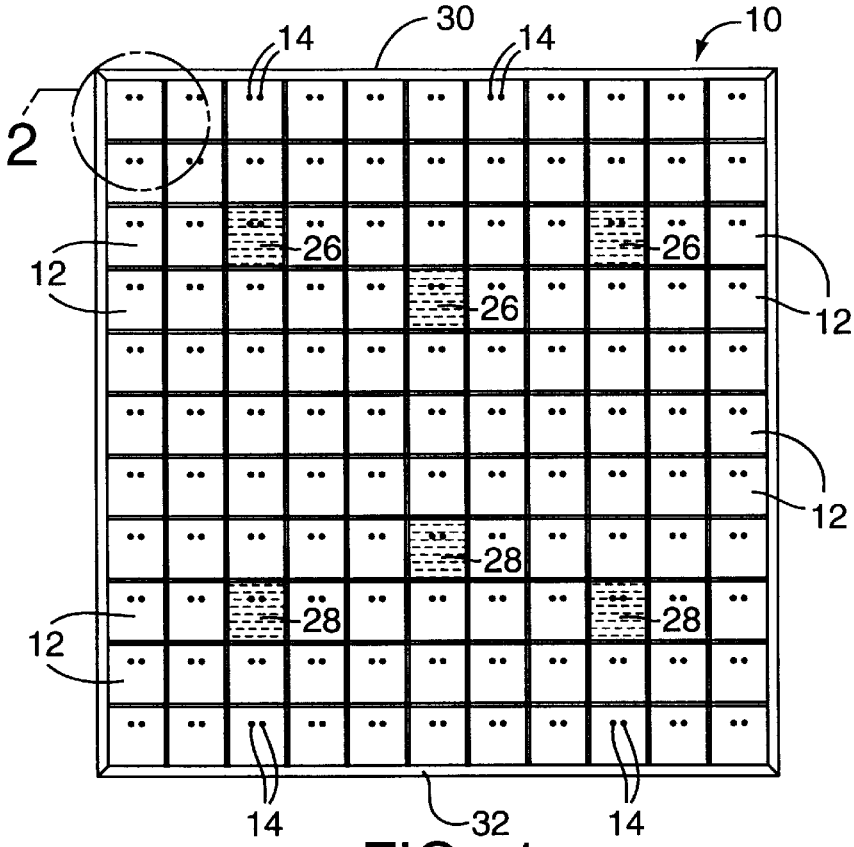
FIG. 1 is a schematic, top view of a game board according to a first embodiment the present invention.
Figure 2:
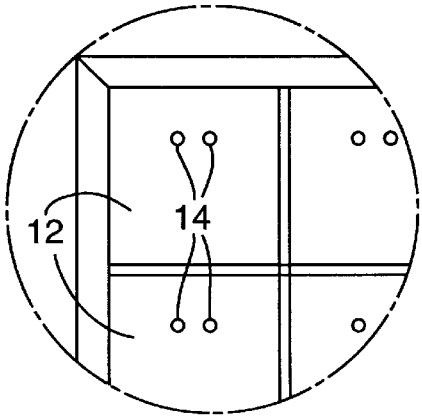
FIG. 2 is a partial, schematic, top view of a game board according to FIG. 1.
Figure 3:
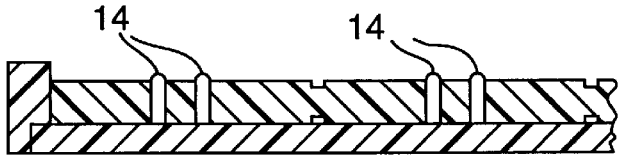
FIG. 3 is a partial, schematic, side cross-sectional view of a game board according to FIG. 1.

A game board (10) according to the present invention is shown in FIG. 1. The game board (10) preferably comprises a plurality of small squares (12) arranged in an 11×11 configuration. It is possible to configure the board with a different number of squares, such as 9×9, or with a pattern of multi-sided shapes other than squares. The material used to construct the game board (10) may be any suitable construction material having sufficient rigidity to support game pieces in a generally flat plane. If desired, the board may alternatively be made from a vinyl sheet, or similar flexible material, and laid on a flat surface. Each square (12) of the game board (10) has directional indicia (14), as shown in FIG. 2, to provide a reference for aligning game piece directional indicia as described below. The directional indicia (14) may comprise a pair of dots or similar markings. In the preferred embodiment, the directional indicia (14) are protrusions or rod tips, as shown in FIG. 3, that are designed to engage mating structures on the individual game pieces for positive retention.

Figure 4:
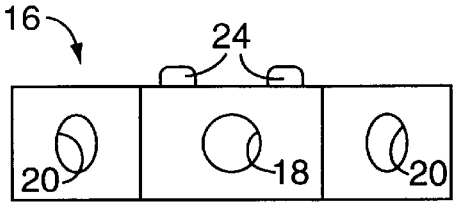
FIG. 4 is a schematic, side view of a first embodiment game piece according to the present invention.
Figure 5:
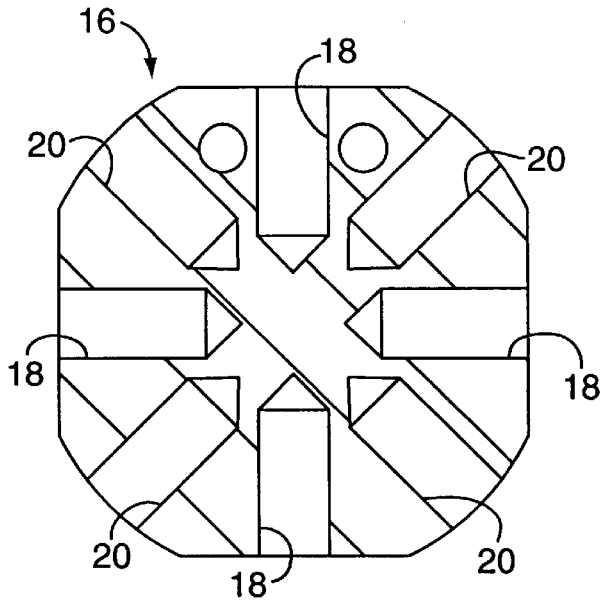
FIG. 5 is a schematic, top, cross-sectional view of a game piece according to FIG. 4.

Referring to FIGS. 4 and 5, the game pieces (16) may each comprise a generally flat, square body. A series of holes (18, 20) are formed on the vertical wall of each game piece (16) and extend toward the center of the game piece (16). The holes (18, 20) are spaced apart at approximately 45 degrees from each other, for a total of eight holes. Four holes (18) occupy flat faces of the generally square configuration, and the other four holes (20) occupy corner sections of the generally square configuration. If desired, the game pieces (16) may be octagonal, round, or of some other shape that enables placement of multiple, evenly spaced holes around the game piece.

Figure 6:
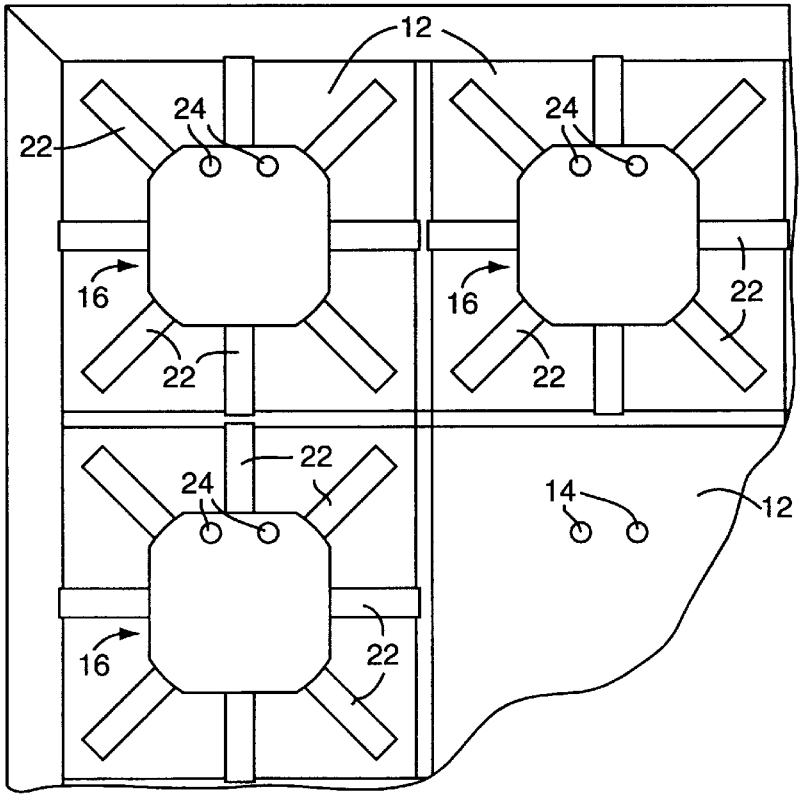
FIG. 6 is a partial, schematic, top view of a game board according to FIG. 1 on which present invention game pieces are positioned.

As illustrated in FIG. 6, each game piece (16) may be fitted with a plurality of up to eight prongs (22) as shown. Each prong (22) may be inserted into one of the holes (18, 20) in accordance with rules of play, as described in the forthcoming example. The lengths of the prongs (22) and the holes (18, 20) may be sized so that a game piece (16) carrying eight prongs (22) may occupy a game board square (12) in a manner in which the square (12) is essentially fully occupied yet the prongs (22) do not extend into adjacent squares. The prongs (22) may be attached to the game pieces in a variety of ways, such as press-fitted into a corresponding hole. Alternatively, for example, the prongs may be snapped into place using snap-retaining means, or they may be attached by magnetic force. One or more prongs (22) may be specially marked or color-coded to signify a special function prong such as, for example, a single prong that enables a game piece to have omni-directional capability.

Directional indicia (24) may be included on the top surface of each game piece (16) for visual indication of directional orientation. In the preferred embodiment, the game piece directional indicia are in the form of a pair of protrusions (24) on the top surface of each game piece (16). A pair of corresponding holes (not shown) are on the bottom surface of each game piece (16) to engage either the game board directional indicia (14) or the game piece directional indicia (24) of another game piece when game pieces (16) are stacked on top of one another. The directional indicia may be of any suitable marking or type that enables visual detection of an orientation direction.

Figure 7:
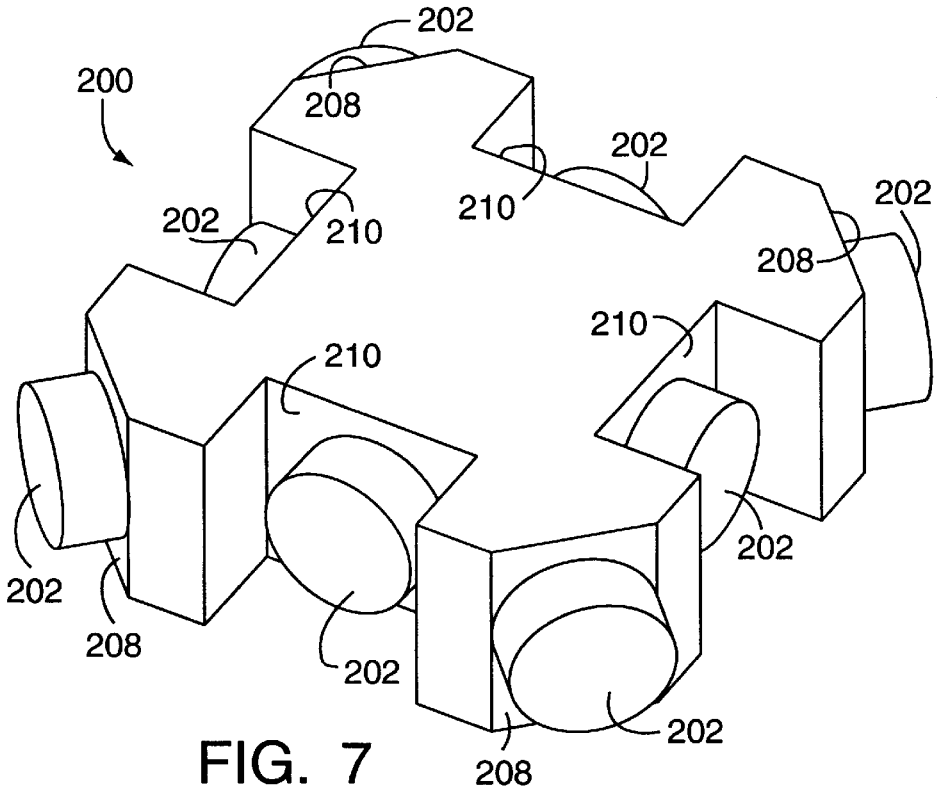
FIG. 7 is an orthogonal view of a second embodiment game piece according to the present invention.
Figure 8:
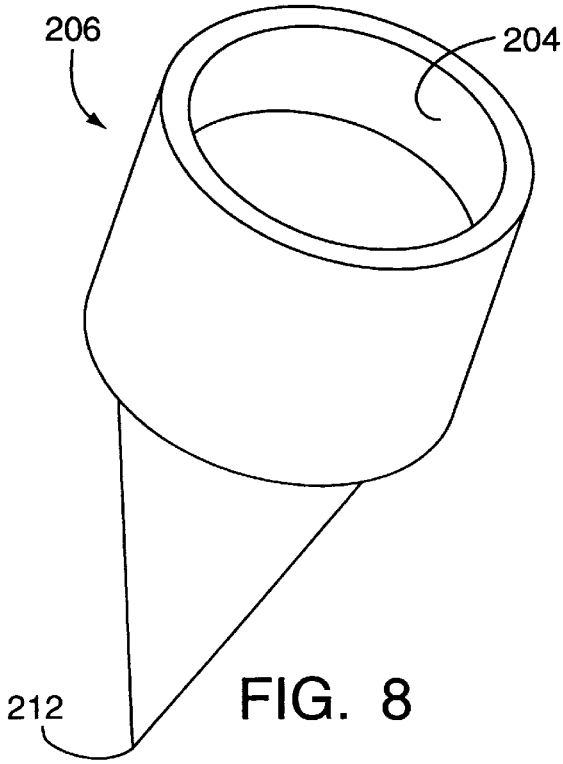
FIG. 8 is an orthogonal view of an accessory game piece for use with the game piece of FIG. 7.
Figure 9:
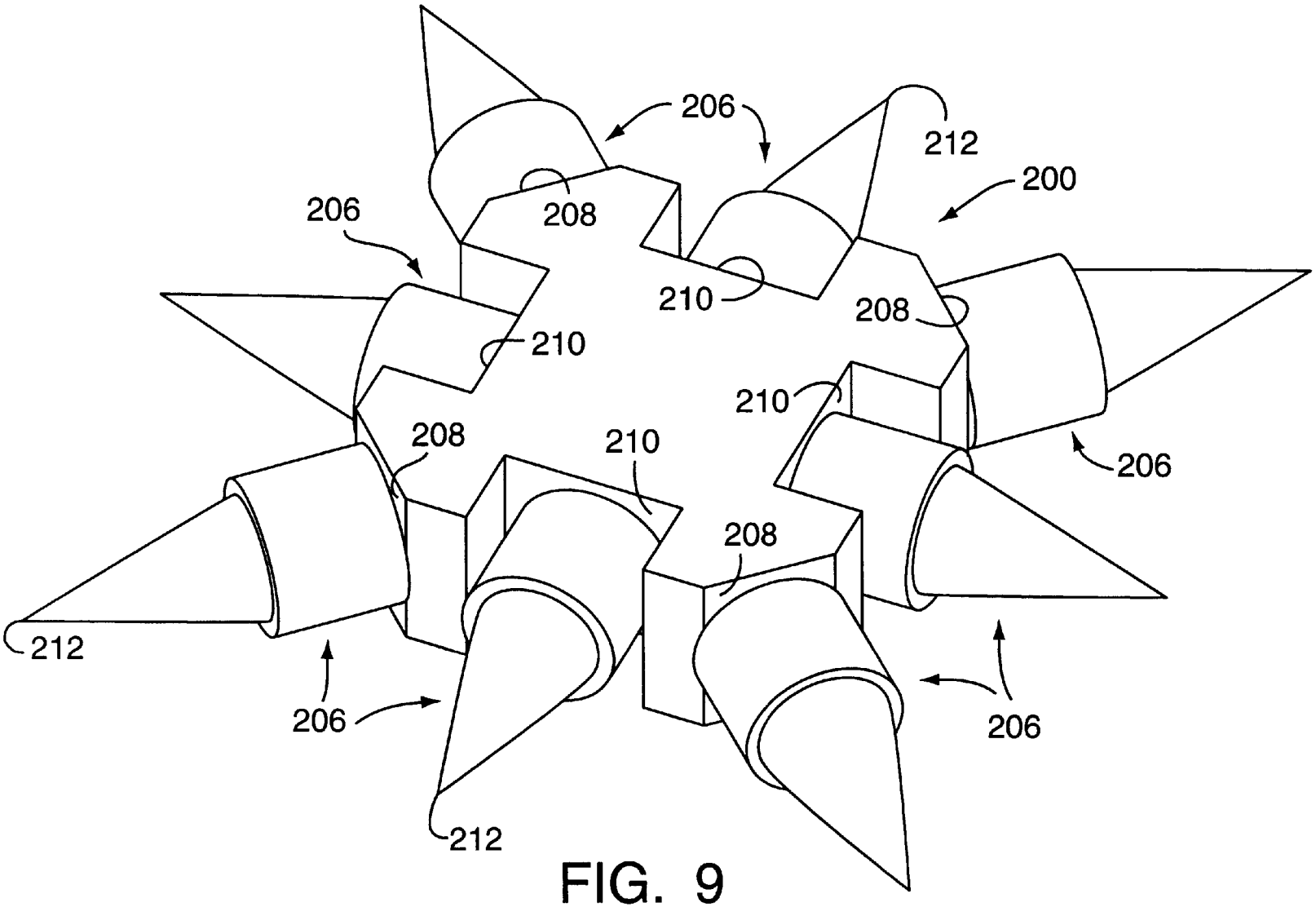
FIG. 9 is an orthogonal view of the game piece according to FIG. 7 and a plurality of the accessory game pieces of FIG. 8, assembled together.

In another embodiment, according to FIGS. 7–9, a game piece (200) of generally square configuration has a plurality of snap-fit members (202). The snap-fit members (202) are adapted to engage snap-fit openings (204) on prongs (206). The corner faces (208) of each game piece (200) are set at a distance from the center of the game piece (200) that is greater than the distance from the center to the side face (210) so that prongs (206) of equal length may be used and the perimeter formed by the prong tips (212) forms a generally square shape that fits within a game board square. Such game piece and prong configurations may be made from molded plastic or other suitable materials.

The game board (10) and game pieces (16) may be played in games according to a variety of rules in which teams and game piece movement characteristics are defined. A game according to a preferred embodiment is described herein. In a two-player game according to the present invention, each player starts with a plurality of game pieces that comprise his or her team. A visual identifier or a different color is used to visually distinguish game pieces from a particular team. Each player starts with nine game pieces (16) and thirty prongs (22).

The game board (10) has six designated starting squares (26, 28). Three starting squares (26) correspond to the first player and the other three starting squares (28) correspond to the second player. The game board (10) is configured so that the starting squares (26, 28) are spaced, symmetrically, on opposing sides (30, 32). In the preferred embodiment, using the bottom left square (12) of FIG. 1 as a coordinate of [0,0], the first player's starting squares are located at coordinates [3,9], [6,8] and [9,9]. The second player's starting squares are located at coordinates [3,3], [6,4] and [9,3]. To start a game, each player puts one game piece (12) on each of his three starting squares (26, 28).

On successive turns, each player chooses to either enhance a game piece (16) or to move a game piece (16). A game piece (16) is enhanced by adding a prong (22) to one of the holes (18, 20). A player may only add one prong (22) or move a game piece (16) one square per turn. The direction of movement is limited to one adjacent square in the direction in which a prong (22) inserted in the game piece (16) corresponds. Thus, at the start of a game, when the game pieces (12) have no prongs (22), a player's turn is limited to adding at least the first prong (22) to a piece (12) before it can be moved.

After a player moves a game piece (12) off of a starting square (26, 28) he may introduce another game piece (12) into the game by placing it on the starting square (26, 28). On successive turns he may add prongs (22) or move the game piece (16) in accordance with the rules for moving a game piece (16) as previously described.

The object of the game is to either occupy all of the opponent's starting squares (26, 28) simultaneously, or to eliminate all of the opponent's game pieces in the manner described below.

A player can eliminate an opponent's game pieces (12) and attached prongs (22) by "jumping" the game piece in a manner similar to that in checkers. A jump is executable when a player's game piece (16) occupies a square adjacent to an opponent's game piece and there is an oppositely positioned square that is vacant. Provided that a prong (22) is present that establishes a permissible direction of movement for a game piece (16), that game piece (16) can jump an opposing piece by moving in the permissible direction. A game piece (16) may make multiple jumps over game pieces (16) that are separated by one vacant square so long as the necessary prongs (22) are present for direction enablement. As the opponent's game pieces (16) are jumped, they are "captured" and removed from the game board (10), along with any prongs (22) attached. A player may jump his own game pieces but they remain on the board. A game piece cannot be jumped more than once in one executable move.

If a player's game piece lands on an opponent's starting square (26, 28), he may recover captured pieces and enter them back in the game. Multiple game pieces from the same team may occupy a single square (12) simultaneously. In that instance, the pieces are stacked vertically and each game piece occupying the square is moveable according to its prong-designated direction on one turn. Alternatively, the stack is movable in compound fashion on one turn, where prongs establish direction and as the stack moves a piece is dropped off with each square moved.

Optionally, the rules of play may include means for each player to designate one or more game board squares as having special characteristics such as, for example, a non-capture designation which permits game pieces to reside on the square with immunity from being captured. Or, such a square may be designated to limit damage from a "jump" to something less than capture. For example, a jump may cause a game piece residing in the square to lose one or more prongs, yet the game piece will remain on the game board, un-captured.

The present invention game described herein may be implemented on personal computers or on a host server for a network. The game may be set up to allow player versus player, or player versus computer.

Figure 10:
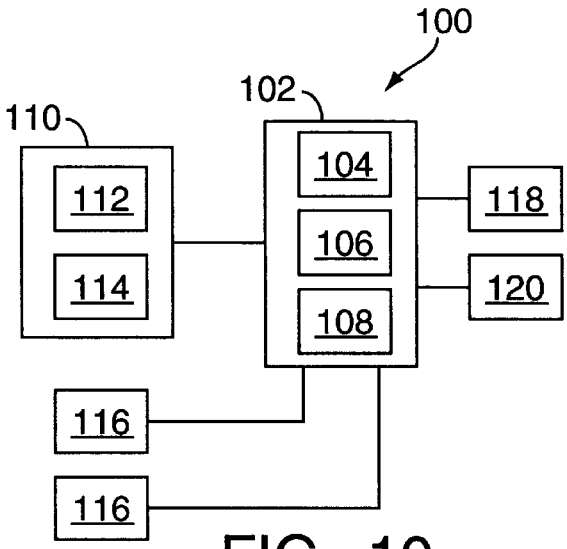
FIG. 10 is a schematic view of a computer game system according to a second embodiment of the present invention.

For player versus player computer games, a local computer residing in the presence of the actual players may host the game. A single personal computer may be loaded with the software to run the game entirely, including channeling input signals from both players. A schematic representation of the game in which two opposing players use one, local personal computer is shown in FIG. 10. The game system (100) as implemented with a personal computer comprises software loaded into and stored on a conventional personal computer (102).

The software (104) comprises an executable install/setup program for installation and initial set up. The initial set up includes such designations as input hardware (i.e., keyboard or joystick), display and sound options, and game parameters of the type described above. The software (104) further includes algorithms for processing player input signals, for detecting permissible and impermissible game piece moves in accordance with pre-programmed rules, for storing data relating to player team and individual game piece status, and for determining a winner of each game. The system further includes player input and graphical display output interfaces. An audio output interface is optional. Conventional graphic display drivers (106) and soundcards (108) are used.

A graphical display device (110) in the form of a conventional PC-compatible display monitor is interfaced with the personal computer (102) for displaying the game board (112) and various game or player status information (114). Optionally, a set of audio speakers (116) may be implemented to deliver pre-preprogrammed audio signals. Player input devices (118, 120), in the form of keyboards or joysticks, are interfaced with the personal computer (102) for delivering player input signals. Alternatively, the software could provide for a single input device to be used for both players whereby alternate turns correspond to each respective player.

In use, the program for running the game is executed on the personal computer (102) and the game board (112) is displayed. Players take turns using the input devices (118, 120) to add, move or enhance game pieces until a winner is declared in accordance with rules of play such as those described above.

Alternatively, the software (104) may include a program that enables a single player to play against the computer (102). The features are essentially the same as those described with respect to FIG. 10, except that additional algorithms exist to enable the program to determine the computer's moves based on pre-programmed, strategic sequences.

Figure 11:
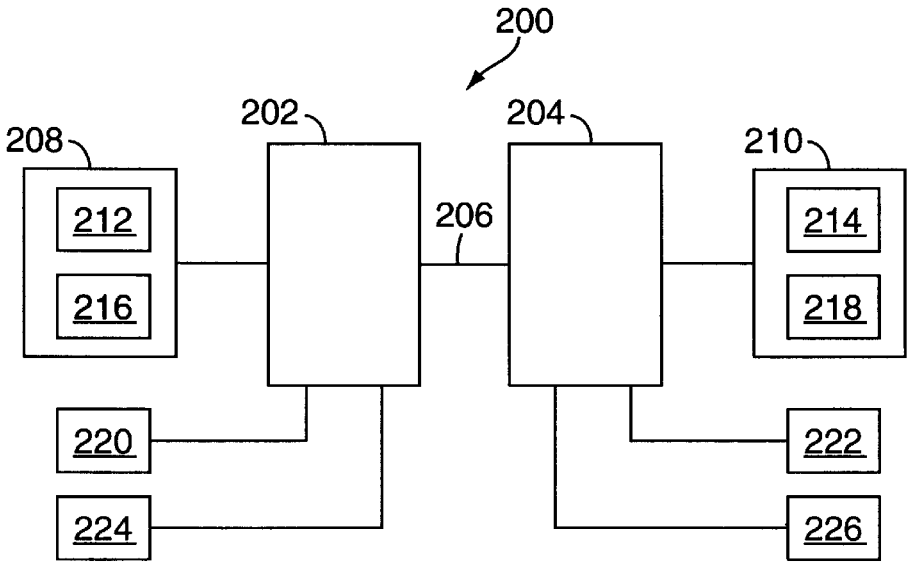
FIG. 11 is a schematic view of a computer game system according to a third embodiment of the present invention.

Referring to FIG. 11, a game system (200) according to the present invention allows two players to play from separate, conventional personal computers (202, 204). The two computers (202, 204) are linked by conventional means such as a cable (206) and each includes essentially the same features as the system (100) described with respect to FIG. 10. Additional algorithms and interfaces are included in each computer (202, 204) for receiving player move input signals from the other computer and for delivering data to the other computer. Each computer display (208, 210) includes a game board (212, 214) and information display (216, 218). Player input devices (220, 222) and optional audio output devices (224, 226) are provided.

Figure 12:
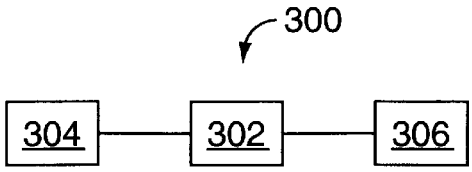
FIG. 12 is a schematic view of a computer game system according to a fourth embodiment of the present invention.

Another embodiment of the present invention is illustrated in FIG. 12, wherein a Web-based game system (300) for implementing a board game as previously described for player versus player or player versus computer play. The system (300) comprises a Web-server (302) that hosts the main software containing a game program essentially similar to those described with respect to FIG. 10 and FIG. 11. A plurality of remotely located computers, such a first personal computer (304) and a second personal computer (306), are loaded with appropriate software to access and run the software on the Web-server (302) to play a game. The remote computers (304, 306) are linked to the Web-server (302) via the Internet. By using conventional programming techniques and tools, such as JAVA (TM), a player at a remote computer (304) may interface with the Web-server (302) and play a game against a remote computer or against another player at another remote computer (306). Using conventional programming techniques, the associated software for player versus player or player versus computer may be implemented in user-optional format.

In the player versus player mode, players at remote computers (304, 306) alternately take turns sending signals indicative of moves and the Web-server (302) runs the associated software to determine the permissibility of the moves, to determine the consequence of the move, and to display the board and game pieces in real-time. In a similar manner, the Web-server interacts with one remote computer for player-versus computer play.

The aforedescribed dynamic features of the game board and game pieces of the present invention enable players to selectively and strategically vary the number of game pieces on the game board and the movement capabilities of the game pieces. This permits an additional degree of strategy not found in other board games.

The specific rules of various games that can be played while implementing the characteristics of the present invention game board and pieces may vary from the example described above. While the preferred embodiment has been herein disclosed, it is acknowledged that the present invention game board and pieces, and associated characteristics, may vary without departing from the scope of the presently claimed invention.

What is claimed is:

1. A board game comprising:

a game board having an array of multi-sided shapes;

a plurality of primary game pieces; and at least one direction indicating means adapted to be selectively removably coupled to said primary game pieces during play of said game such that each of said direction indicating means extends along and activates one of a plurality of permissible movement-capable directions of an associated primary game piece, the primary game pieces during each turn of play either being capable of movement in activated movement-capable directions or being activated by a direction indicating means for movement in a new movement-capable direction.

2. A board game according to claim 1, wherein said primary game pieces each have orientation indicia for establishing orientation of each primary game piece with respect to said board.

3. A board game according to claim 2, wherein said orientation indicia include visually perceptible markings.

4. A board game according to claim 2, wherein said orientation indicia include physical locking means for locking said primary game pieces in a predetermined orientation with respect to a multi-sided shape on said board.

5. A board game according to claim 1, wherein said direction indicating means includes a plurality of secondary game pieces, each secondary game piece being adapted to be selectively removably attached to one of said primary game pieces to extend along and to activate one of a plurality of permissible movement-capable directions of an associated primary game piece.

6. A board game according to claim 1, wherein said multi-sided shapes are squares.

7. A board game according to claim 1, wherein each primary game piece includes a generally flat, multi-sided body.

8. A board game according to claim 7, wherein said direction indicating means are adapted to be selectively attached to said primary game pieces in a generally evenly spaced configuration around each said primary game piece.

9. A board game according to claim 8, wherein said direction indicating means are spaced from each other at approximately 45 degree intervals.

10. A board game according to claim 1, wherein said direction indicating means include rod-shaped objects each adapted to be removably attached to said primary game pieces to extend along and to activate one of a plurality of permissible movement-capable directions of an associated primary game piece.

11. A board game according to claim 10, wherein said primary game pieces define a plurality of generally evenly-spaced holes adapted to receive said direction indicating means.

12. A board game according to claim 1, further comprising:

at least one starting multi-sided shape in which said primary game pieces are positioned initially when introduced during play of said game prior to moving to any other multi-sided shape.

13. A game piece for a board game comprising:

a body of a game piece;

at least one direction indicating means to be removably received by the body of the game piece so as to be aimed in a direction of movement enablement from among a plurality of possible directions for the body of the game piece, the body during each turn of play either being capable of movement in movement enabled directions or being activated by a direction indicating means for movement in a new movement enabled direction.

14. A game piece according to claim 13, wherein said direction indicating means include a plurality of secondary game pieces, each secondary game piece being adapted to be selectively removably attached to said body.

15. A game piece according to claim 13, wherein said body has orientation indicia for establishing orientation of said body with respect to a game board.

16. A game piece according to claim 15, wherein said orientation indicia include visually perceptible markings.

17. A game piece according to claim 13, wherein said body is a generally flat, multi-sided body.

18. A game piece according to claim 13, wherein said direction indicating means are adapted to be selectively attached to said body in a generally evenly spaced configuration around said body.

19. A game piece according to claim 18, wherein said direction indicating means are spaced from each other at approximately 45 degree intervals.

20. A game piece according to claim 13, wherein said direction indicating means include rod-shaped objects each adapted to be removably attached to said body.

21. A game piece according to claim 20, wherein said body defines a plurality of generally evenly-spaced holes adapted to receive said direction indicating means.

22. A method of playing a board game on a game board having an array of multi-sided shapes thereon and in which opposing players take successive turns, said method comprising:

a first player introducing a first game piece on a selected introduction location comprising one of said multi-sided shapes;

a second player introducing a second game piece on another selected introduction location comprising one of said multi-sided shapes;

said first player designating a direction along which the first game piece may move from among a plurality of possible directions by activating visually perceptible direction indicating means pointing toward the direction along which the first game piece may move;

said second player designating a direction along which the second game piece may move from among a plurality of possible directions by activating visually perceptible direction indicating means pointing toward the direction along which the second game piece may move; and each player taking successive turns advancing said game pieces on said game board or designating further direction along which the game pieces may move.

23. A method according to claim 22, wherein each said game piece may have up to eight directions along which the game piece may move.

24. A method according to claim 22, wherein each said game piece may be introduced into said game on one of a variety of selected introduction locations, each introduction location comprising one of said multi-sided shapes.

25. A method according to claim 22, wherein said visually perceptible direction indicating means include rods that are adapted to be selectively attached to said game pieces.

26. A computer game system for playing a game having two teams of primary game pieces movable on a game board, comprising:

a computer having data input means for inputting data indicative of a player's intention to cause movement of or addition of a primary game piece on a game board, the data including at least one direction indicating means to be selectively removably associated with the primary game pieces during play of the game such that the direction indicating means extends along and activates one of a plurality of permissible movement-capable directions of an associated primary game piece, a primary game piece during each turn of play either being capable of movement in activated movement-capable directions or being activated by a direction indicating means for movement in a new movement-capable direction;

a processor associated with the first computer for processing the input data in accordance with preprogrammed parameters to determine the status of one or more of the primary game pieces on the game board; and output display means for displaying the primary game pieces on the game board.

27. A system according to claim 26, wherein said game board displayed on the display means includes an array of multi-sided shapes for movement of the primary game pieces thereon.

28. A system according to claim 26, wherein said direction indicating means comprise a plurality of secondary game pieces, each secondary game piece being adapted to be selectively depicted on said display means as extending along and activating one of a plurality of permissible movement-capable directions of an associated primary game piece.

29. A system according to claim 26, wherein one of said teams of primary game pieces is controlled by a first player and the other team of primary game pieces is controlled by a computer.

30. A system according to claim 26, wherein one of said teams of primary game pieces is controlled by a first player and the other team of primary game pieces is controlled by a second player.

31. A system according to claim 26, further comprising:

remotely located computer interfaced with said first computer, wherein said processor is located in said remotely located computer.

32. A system according to claim 31, further comprising:

a second computer interfaced with said remotely located computer and having data input means for inputting data indicative of a player's intention to cause movement of or addition of one or more of said plurality of primary game pieces, whereby said first computer and said second computer control one of said teams of primary game pieces.

* * * * *